US011859826B2

(12) United States Patent
Fong et al.

(10) Patent No.: US 11,859,826 B2
(45) Date of Patent: Jan. 2, 2024

(54) LOW PROFILE TERMINATION CAP FOR DIRECT VENT APPLIANCE

(71) Applicant: Wolf Steel Ltd., Barrie (CA)

(72) Inventors: Derek Fong, Barrie (CA); Paul Hodges, Richmond Hill (CA); Ciprian Gherghel, Newmarket (CA); David Shulver, Richmond Hill (CA); Cliff Lilley, Anten Mills (CA)

(73) Assignee: Wolf Steel Ltd., Barrie (CA)

( * ) Notice: Subject to any disclaimer, the term of this patent is extended or adjusted under 35 U.S.C. 154(b) by 606 days.

(21) Appl. No.: 16/810,102

(22) Filed: Mar. 5, 2020

(65) Prior Publication Data

US 2020/0284436 A1 Sep. 10, 2020

Related U.S. Application Data

(60) Provisional application No. 62/815,889, filed on Mar. 8, 2019.

(51) Int. Cl.
*F24B 1/19* (2006.01)
*F24C 15/00* (2006.01)
(Continued)

(52) U.S. Cl.
CPC ..... *F24B 1/1902* (2013.01); *F24C 15/002* (2013.01)

(58) Field of Classification Search
CPC ..... F24B 1/1902; F24B 1/19; F24B 1/1895; F24C 15/002; F24C 15/001; F24F 7/08; F24F 13/26; F24F 2013/0612; F24F 2013/0616; F24F 11/0002; F24F 11/17; F24F 11/48; F24F 12/006
(Continued)

(56) References Cited

U.S. PATENT DOCUMENTS 2,647,477 A * 8/1953 Woodward ..... F24C 15/002 126/307 R
2,754,816 A * 7/1956 Ryder ..... F23L 17/04 126/307 R
(Continued)

FOREIGN PATENT DOCUMENTS

AU 2004100674 A4 * 9/2004 ..... F23L 17/04
CA 2310518 C * 7/2008 ..... F23L 17/04
(Continued)

OTHER PUBLICATIONS

"JP_03271615_A_I-Machine Translation.pdf", machine translation, Japan Platform for Patent Information (JPlatPat), Jul. 2, 2022. (Year: 2022).*

*Primary Examiner* — Steven B McAllister
*Assistant Examiner* — Daniel E. Namay
(74) *Attorney, Agent, or Firm* — Honigman LLP

(57) ABSTRACT

A termination cap for a direct vent appliance. The termination cap comprises an outer housing, an exhaust housing nested within the outer housing and a trim plate. The trim plate has an exhaust gas opening and combustion air openings and is securable to the exhaust body to allow exhaust gas to flow through the exhaust gas opening. At least a portion of the combustion air drawn through the combustion air openings is heated and exits through the top or upper portion of the trim plate to form an air wash along the wall surface within which the cap is mounted.

13 Claims, 7 Drawing Sheets

(51) Int. Cl.
*F24B 1/191* (2006.01)
*F24B 1/189* (2006.01)

(58) Field of Classification Search
USPC ..... 126/518, 15 R, 77, 80, 515, 112; 454/8, 454/243, 244, 271, 276, 283
See application file for complete search history.

(56) References Cited

U.S. PATENT DOCUMENTS 2,764,972 A * 10/1956 Ryder ..... F24C 15/002 126/307 R
2,811,095 A * 10/1957 Moran ..... F24C 15/002 126/307 R
2,863,442 A * 12/1958 Moran ..... F24C 15/002 126/85 R
2,998,764 A * 9/1961 Bedell ..... F23J 13/04 126/85 B
3,105,432 A * 10/1963 Chamberlain ..... F24C 15/002 126/85 B
3,136,309 A * 6/1964 Martz ..... F24C 3/004 126/307 R
3,192,852 A * 7/1965 Stark ..... F24C 15/002 126/85 B
3,327,609 A * 6/1967 Sage ..... F24C 15/002 126/85 B
3,428,040 A * 2/1969 Baker ..... F24C 3/004 126/307 R
3,429,307 A * 2/1969 Eubanks ..... F24C 15/002 126/94
3,435,816 A * 4/1969 De Werth ..... F24C 15/002 126/85 B
3,521,547 A * 7/1970 Hodges ..... F24C 15/002 454/243
3,552,377 A * 1/1971 Hodges ..... F24C 15/002 126/307 R
3,643,646 A * 2/1972 Honaker, Jr. ..... F23L 17/04 126/307 R
3,662,735 A * 5/1972 Jackson ..... F24C 3/004 126/307 R
4,224,921 A * 9/1980 Petrescue ..... F24B 1/1902 126/518
5,715,808 A * 2/1998 Wilhoite ..... F23L 17/08 126/85 B
6,053,162 A * 4/2000 Godfree ..... F23L 17/04 126/293
7,665,457 B2 * 2/2010 Jacklich ..... F24C 15/002 126/84
8,056,552 B2 * 11/2011 Jacklich ..... F24C 15/002 126/84
8,230,849 B2 * 7/2012 Jacklich ..... F24C 15/002 454/231
2008/0271726 A1 * 11/2008 Jacklich ..... F24C 15/002 126/80
2009/0308381 A1 * 12/2009 Jacklich ..... F24C 15/002 126/85 B
2010/0037883 A1 * 2/2010 Jacklich ..... F24C 15/002 126/77

FOREIGN PATENT DOCUMENTS

JP 01310222 A * 12/1989 ..... F23L 17/04
JP 02017314 A * 1/1990 ..... F23L 17/04
JP 03271615 A * 12/1991 ..... F23L 17/04
NZ 500380 A * 5/2001 ..... F23L 17/04

* cited by examiner

LOW PROFILE TERMINATION CAP FOR DIRECT VENT APPLIANCE

FIELD

This invention relates to the field of direct vent appliances and fireplaces, and in one particular embodiment terminations or termination caps for the exhaust gas discharge and combustion air intake of a direct vent fireplace.

BACKGROUND

On account of their increased efficiency, direct vent appliances, and in particular direct vent fireplaces and heating systems, are in common use. Typically, in a direct vent application a concentric vent is utilized wherein combustion exhaust gases are channeled away from a fireplace or appliance into an exterior environment through an inner pipe or conduit. That conduit, or vent as it is sometimes referred to, is usually surrounded by a generally concentric outer pipe or conduit through which intake air is drawn into the appliances' combustion chamber. The concentric exhaust gas and intake air structure provides a number of advantages, including increased efficiency as heat that would otherwise escape into the exterior environment with the exhausted gases is used to pre-heat incoming combustion air. Direct vent appliances also offer the advantage of drawing air exterior to the local environment into the appliance so that room air adjacent to the appliance is not used for combustion purposes.

To prevent water, snow, animals, and other debris or material from entering the venting of the appliance, and to also help direct the exhaust gases that are expelled from the venting in a manner that minimizes the likelihood that they become recirculated and drawn back in as intake air or cause damage to the surrounding building structures, the end of the concentric venting is typically fitted with a termination or termination cap. In the case of a direct vent fireplace, such caps are commonly installed within an exterior wall of the building in which the fireplace is situated.

Current termination caps that are in use tend to be rather large and bulky structures that are often not aesthetically pleasing, and that can extend to a significant degree beyond the exterior surface of the wall within which they are mounted. In the case of a direct vent fireplace, termination caps are at times mounted on the back wall of a home, which may present the cap within the area of an exterior deck, patio or outdoor living space. As well, current termination caps may be prohibited by local by-laws based on their appearance or due to the limited size of the property lot.

SUMMARY

In one embodiment there is thus provided a termination cap for a direct vent appliance, the termination cap comprising an outer housing having an interior surface, an outer end, and an inner end that is in fluid communication with a combustion air conduit to deliver combustion air to the appliance; an exhaust body nested within the outer housing and having an exterior surface at least partially offset from the interior surface of the outer housing thereby forming a combustion air passageway between the exterior surface of the exhaust body and the interior surface of the outer housing, the exhaust body having an inner end in fluid communication with an exhaust conduit from the appliance; and a trim plate having an exhaust gas opening therethrough, the trim plate securable to the exhaust body such that exhaust gases within the exhaust body are permitted to pass through the exhaust gas opening, the trim plate including one or more side portions securable to the outer end of the outer housing, the one or more side portions of the trim plate including combustion air openings to permit the passage of combustion air wherein the combustion air passing through the combustion air openings contacts the exterior surface of the exhaust body, wherein combustion air drawn through the combustion air openings in the one or more side portions of the trim plate is heated by the exhaust body causing a portion said air to rise within the combustion air passageway and to exit the combustion air passageway through one or more of the combustion air openings located at or near a top of the termination cap, air exiting the said one or more combustion air openings creating an air wash along a surface of a wall of a structure within which the termination cap is mounted to help protect the surface from damage from contact with exhaust gases exiting the termination cap.

In a further embodiment there is provided a termination cap for a direct vent appliance, the termination cap comprising an outer housing having an interior surface, an outer end, and an inner end that is in fluid communication with a combustion air conduit to deliver combustion air to the appliance; an exhaust body nested within the outer housing and having an exterior surface at least partially offset from the interior surface of the outer housing thereby forming a combustion air passageway between the exterior surface of the exhaust body and the interior surface of the outer housing, the exhaust body having an inner end in fluid communication with an exhaust conduit from the appliance; a trim plate having an exhaust gas opening therethrough, the trim plate securable to the exhaust body such that exhaust gases within the exhaust body are permitted to pass through the exhaust gas opening, the trim plate including one or more side portions securable to the outer end of the outer housing, the one or more side portions of the trim plate including combustion air openings to permit the passage of combustion air therethrough wherein the combustion air passing through the combustion air openings contacts the exterior surface of the exhaust body, and a deflector positioned along an outer surface of the trim plate adjacent to a top of the termination cap and adjacent to the exhaust gas opening, the deflector aiding in deflecting exhaust gases expelled through the exhaust gas opening of the trim plate away from the wall of a structure within which the termination cap is mounted, wherein combustion air drawn through the combustion air openings in the one or more side portions of the trim plate is heated by the exhaust body causing a portion of said air to rise within the combustion air passageway and to exit the combustion air passageway through one or more of the combustion air openings located at or near the top of the termination cap, air exiting the said one or more combustion air openings creating an air wash along a surface of the wall of the structure within which the termination cap is mounted to help protect the surface from damage from contact with exhaust gases exiting the termination cap.

A still further embodiment of the invention there is provided a termination cap for a direct vent appliance, the termination cap comprising an outer housing, an exhaust body nested within the outer housing, and a trim plate, the trim plate has an exhaust gas opening and combustion air openings, and is securable to the exhaust body to allow exhaust gas to flow from an interior of the exhaust body through the exhaust gas opening and to permit combustion air to flow though the combustion air openings and into a combustion air passageway formed from an interior surface of the outer housing and an interior surface of the exhaust body, at least a portion of the combustion air within the combustion air passageway is heated by the exhaust body during operation of the appliance and exits through a top or upper portion of the trim plate to form an air wash along a surface of a wall of a structure within which the cap is mounted.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. The specification and drawings that follow describe and disclose some of the specific forms of the invention.

Figure 1:
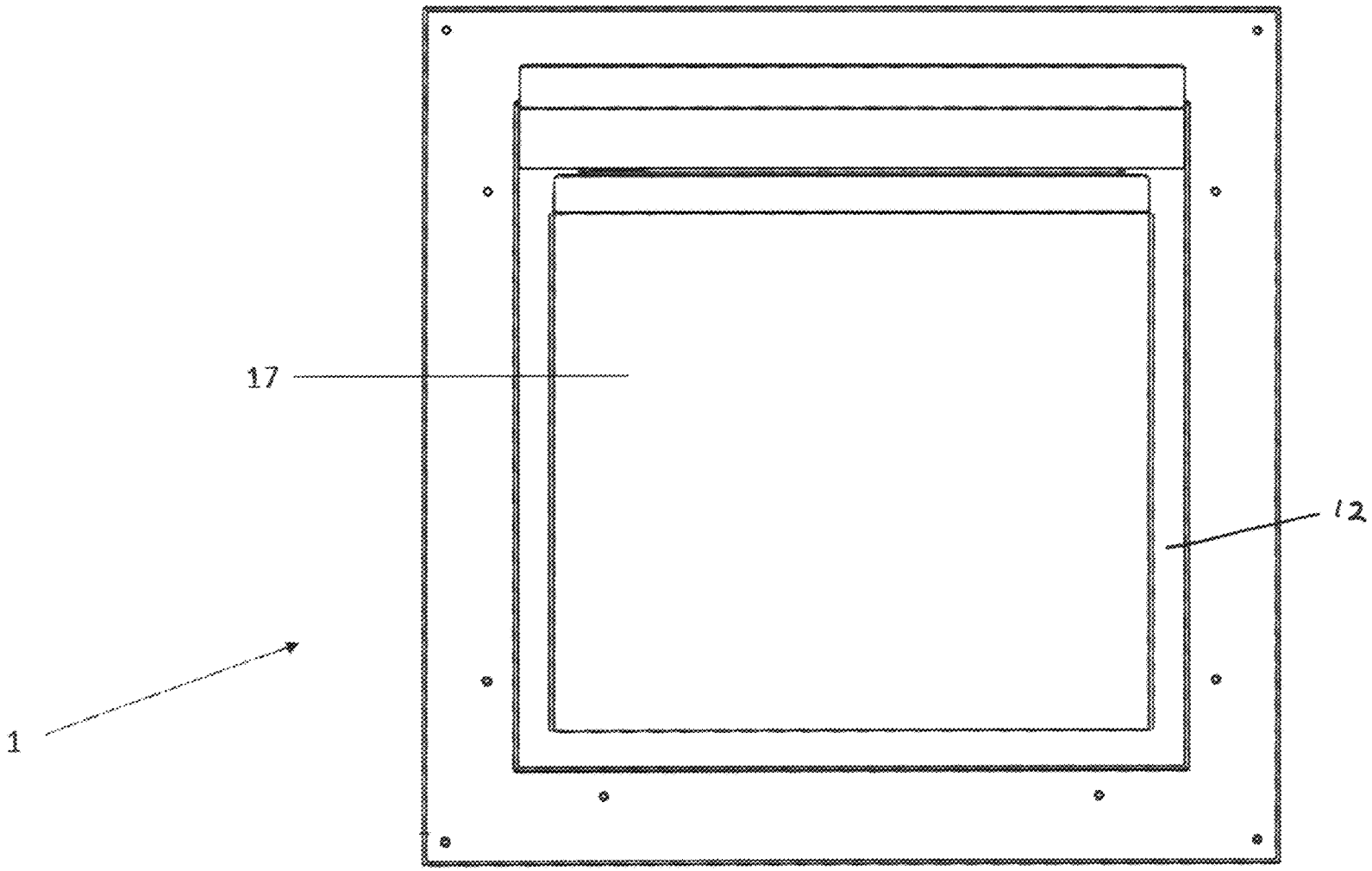
FIG. 1 is a front view of a termination cap constructed in accordance with an embodiment of the current invention.
Figure 2:
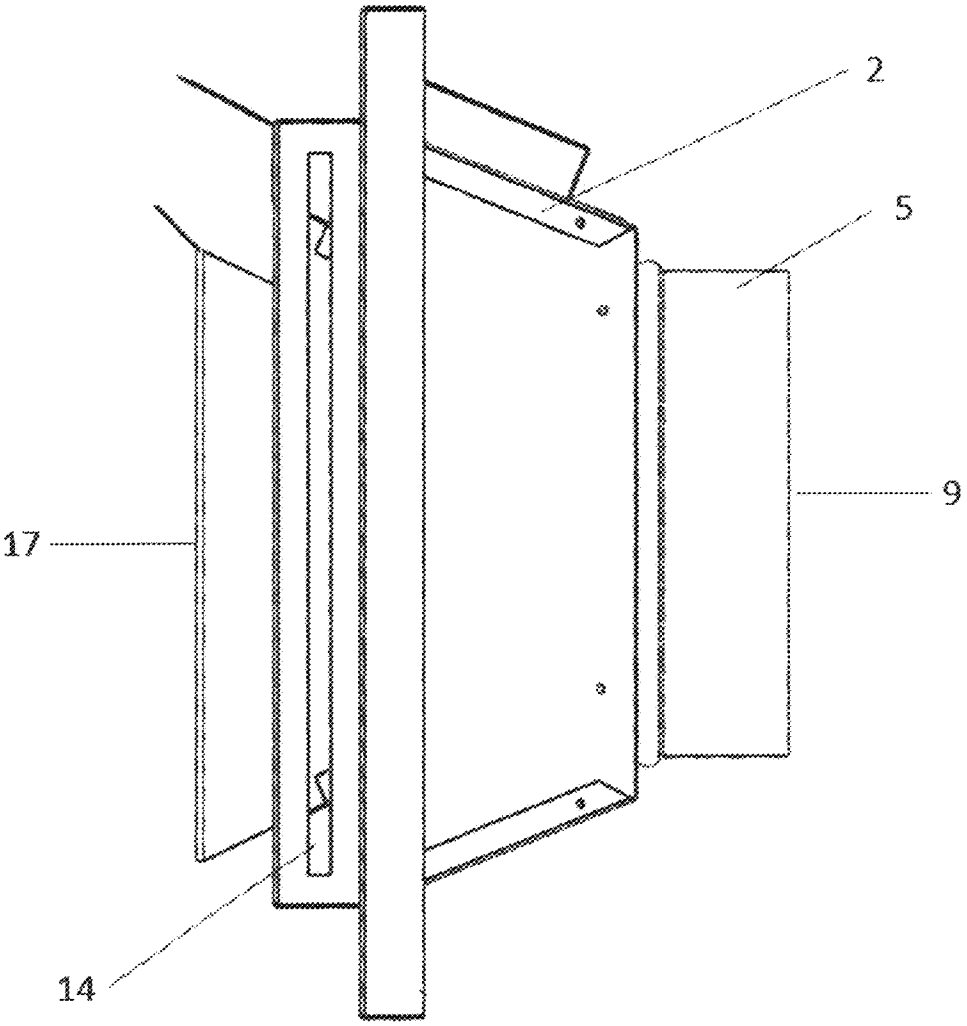
FIG. 2 is a side view of the termination cap of FIG. 1.
Figure 3:
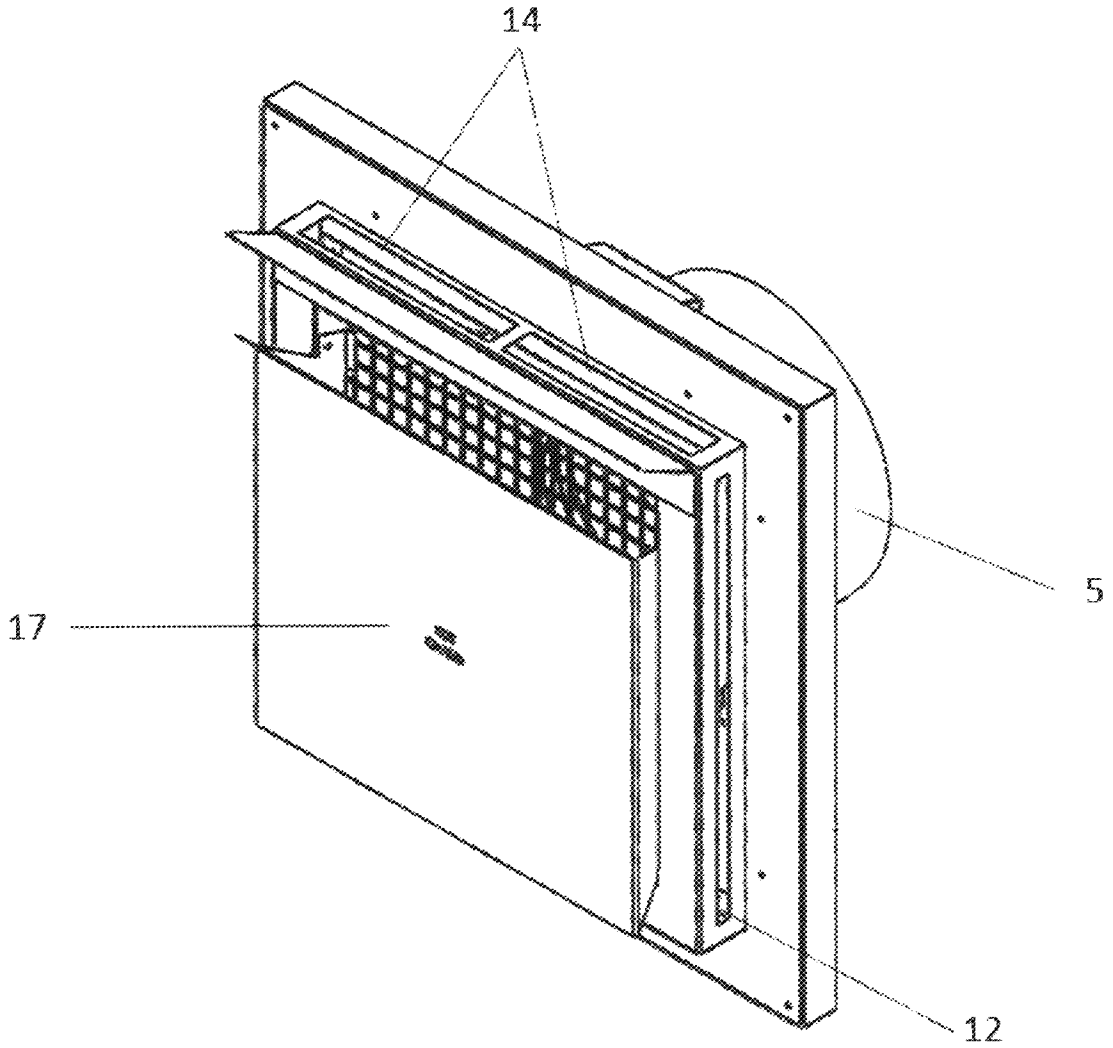
FIG. 3 is an upper front perspective view of the termination cap of FIG. 1.
Figure 4:
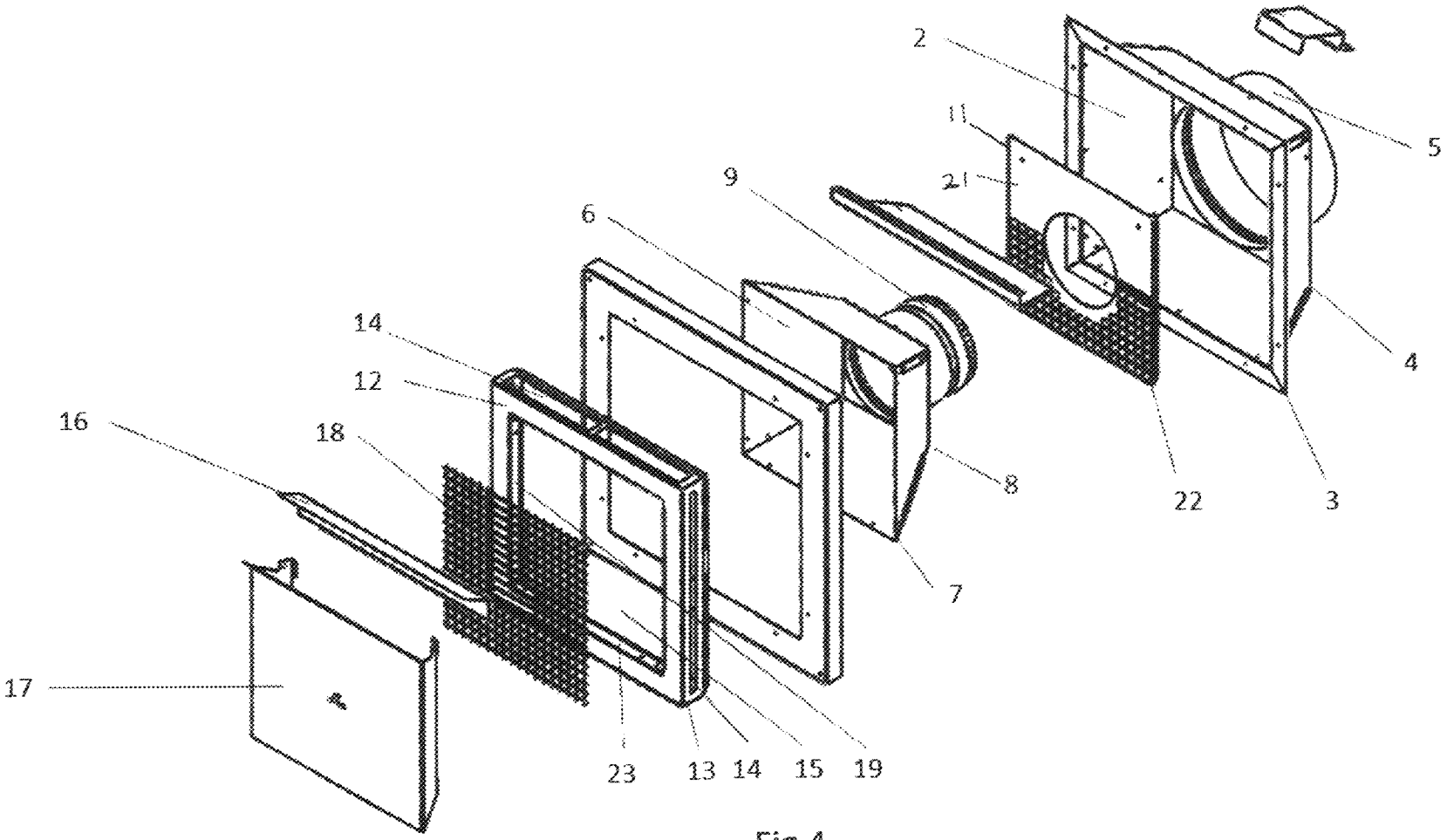
FIG. 4 is an exploded view of the termination cap of FIG. 3.

With reference to the attached drawings, there is shown an embodiment of a termination cap 1 for a direct vent appliance 25, which may be a direct vent fireplace. Cap 1 is comprised generally of a flared outer housing 2 having a first or outer end 3, that is in communication with the source of combustion air and that may be attached to an exterior wall with a flange, and a second or inner end 4 that is operably connectable to or otherwise associated with a conduit to supply combustion air to the appliance or fireplace. In one embodiment, the sides of flared housing 2 slope inwardly toward second end 4 (see FIG. 4). As is common in the case of termination caps, an outer collar 5 may be used for purposes of providing a transition between the termination cap and a pipe or conduit that supplies combustion air to the fireplace. Termination cap 1 further includes an exhaust body 6 received within flared housing 2. Exhaust body 6 has a first or outer end 7 in communication with an exterior environment and a second opposite or inner end 8 in fluid communication with an exhaust conduit that transports exhaust gases from the appliance, through exhaust body 6 and into the exterior environment. Once again, as is common in the case of termination caps, cap 1 may be fitted with an inner collar 9 that serves to provide a means by which exhaust body 6 may be secured to an exhaust conduit or pipe to permit exhaust to flow from the fireplace, through inner collar 9, into exhaust body 6, and finally out first end of the exhaust body and into the exterior environment.

Exhaust body 6 may be shaped to be complementary to flared housing 2 so that the two components can be nested together. In the embodiment shown, flare housing 2 and exhaust body 6 are nested truncated pyramids, however, other shapes and configurations for housing 2 and exhaust body 6 are possible. Exhaust body 6 has an exterior surface that is at least partially offset from an interior surface of flared housing 2 to create a combustion air passageway 10 situated between the exterior surface of the exhaust body and the interior surface of the flared housing. To accommodate that offset, and to help centralize exhaust body 6 within flared housing 2, termination cap 1 further includes a trim plate 12. Trim plate 12 has a generally open front surface 15 that forms an exhaust gas opening. One or more inner flanges 23 may be used to connect the trim plate, along the inner edged of the open front surface 15, to the first end 7 of exhaust body 6. Flanges 23 thus define an exhaust gas passageway from the interior of the exhaust body through exhaust gas opening 15. Trim plate 12 further has one or more sides 13 extending from its outer edges which connect to the interior edge of flared housing 2. In this manner, trim plate 12 creates a offset between exhaust body 6 and flared housing 2 so that the sides of exhaust body 6 are generally positioned an equal distance away from the interior surface of flared housing 2.

In an alternate embodiment (not shown), one or both of the interior surface of flared housing 2 and the exterior surface of exhaust body 6 may be fitted with fins or other such structures that help to position and maintain exhaust body 6 within flared housing 2 such that the sides of the exhaust body are generally an equal distance away from the interior surface of the flared housing to present a combustion air passageway that allows for an efficient draw of air into the fireplace.

Returning to the depicted embodiment, as noted above, trim plate 12 has an inner surface 19 and an outer surface 20. As noted above, trim plate 12 has one or more sides 13 extending from outer surface 20 and is secured to or otherwise in contact with first end 3 of flared housing 2. One or more of sides 13 contain one or more combustion air openings 14 to allow combustion or intake air to be drawn (i) first into a void formed by the exterior surface of exhaust body 6 and the one or more sides of the trim plate, and (ii) subsequently into combustion air passageway 10. In the embodiment of the invention shown in the attached drawings, trim plate 12 is square or rectangular in shape having four sides 13 at its perimeter, each having a pair of elongate, generally rectangular shaped, openings 14. In this embodiment, generally open front surface 15 that forms the exhaust gas opening is also square or rectangular in shape. Other configurations of trim plate 12 and openings 14 are possible and are contemplated.

To further help direct exhaust exiting exhaust body 6 away from termination cap 1, trim plate 12 may include a deflector 16 that in one preferred embodiment is positioned along the top or upper side of the trim plate. Deflector 16 serves the purpose of helping to deflect hot exhaust gases that exit exhaust body 6 and that rise upwardly from the outer surface of the termination cap away from the cap and also away from the surface of the building or structure within which it is situated.

An outer shield 17 is preferably secured over open front 15 of trim plate 12 in a manner that sets the shield off from the trim plate to help prevent debris or material from entering into exhaust body 6, while at the same time presenting an exhaust flow passage or route between shield 17 and trim plate 12 that allows for exhaust gases exiting through open front 15 to escape into the exterior environment. Outer shield 17 may also serve to prevent rain and wind from entering exhaust body 6. The heat of the exhaust gas acting on outer shield 17 also contributes to the convective air flow within termination cap 1, as the heated exhaust gas tends to rise as it travels through open front 15 and, thus, exit from an upper portion of open front 15 past outer shield 17. An internal mesh or screen 18 may also be utilized to prevent debris and other matter from being drawn into flared housing 2 or from finding its way into exhaust body 6. Screen 18 may also serve to prevent animals from entering into exhaust body 6.

Figure 5:
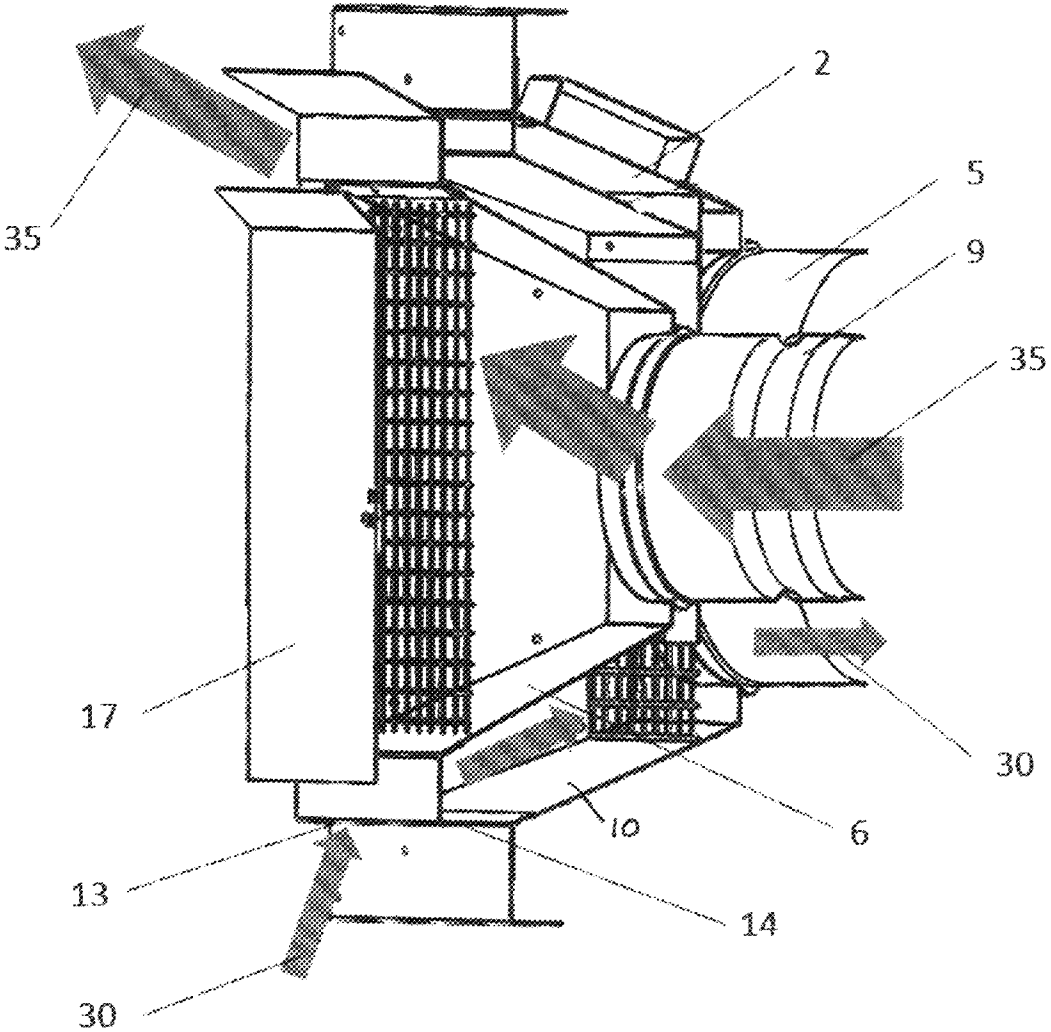
FIG. 5 is a vertical cross-sectional view of the termination cap of FIG. 1 showing the flow of exhaust gas and combustion air.

In operation, combustion air 30 is drawn through openings 14 in sides 13 of trim plate 12. While air for combustion purposes may be drawn through any of openings 14 in sides 13, in the present embodiment, a majority of the air for combustion purposes may be drawn through openings 14 in the bottom side 13 of trim plate 12 (see FIG. 5 for example). As will be described in greater detail below, a portion of the combustion air may be used for "air wash" purposes, which may also be drawn through any of openings 14 in sides 13. In the present embodiment, a majority of the air for air wash purposes may be drawn through openings 14 in the left and right sides 13 of trim plate 12.

Combustion air 30 is thus drawn into the void created by the outer surface of exhaust body 6 and sides 13 of trim plate 12, and then into flared housing 2 before entering the pipe or conduit that transports it to the fireplace. Exhaust gases 35 are delivered to exhaust body 6, which itself is of a flared construction similar to that of flared housing 2, and out through open front 15 of trim plate 12.

Flared housing 2 has a flared shape in order to optimize the velocity of the exhaust gas as it prepares to exit termination cap 1. This shape may also help to prevent restriction to the combustion process within the fireplace, and so that the exhaust gas exit velocity is maximised to help it to be expelled from the terminal and projected forward and upward away from the building's wall.

To help reduce exterior building wall temperatures, to help minimize the recirculation of exhaust gases back into the combustion air flow stream, and help to improve wind resistance, deflector 16 may be situated at the top of trim plate 12 and generally within or adjacent to the gap or opening between trim plate 12 and shield 17.

Those of skill in the art will appreciate that termination cap 1 is unique and distinguished in that it largely protrudes into the structure or wall within which it is situated, unlike traditional termination caps that protrude outwardly. Such a design permits for a considerably thinner exterior profile of the cap providing a more aesthetic visual appearance. This design also helps to reduce the exposure of termination cap 1 to outside weather temperatures and elements which may be highly variable. This may help to maintain termination cap 1 in a more consistent environment and, thus, allow it to perform its function in a more consistent manner.

A further advantage provided by the particular structure of termination cap 1 is that it presents a unique "air wash" system (noted generally above) that helps to protect the exterior surface of the wall or structure within which the termination cap is mounted from the effects of high temperature exhaust gases. In the embodiment of the invention shown in FIG. 6, a portion of the combustion air that is drawn into cap 1 through openings 14 in sides 13 of trim plate 12 will be heated, as it passes about the exterior surface of exhaust body 6, to a degree that it will tend to rise. A portion of the heated combustion air becomes "air wash" air 40. While the "air wash" air may be heated above ambient air temperatures, its temperature will nevertheless tend to remain sustainably below the high temperature of the exhaust gases.

At least a portion of the rising heated combustion air is allowed to exit through openings 14 that are in the top or upper side 13 of trim plate 12, causing an "air wash" effect along the surface of the building immediately above termination cap 2. In other words, relative to the high temperature exhaust gases, this "heated" portion of the combustion air (or "air wash" air) is relatively cool, yet sufficiently heated so as to rise through openings 14 that are in the top or upper side 13 of trim plate 12. In this manner, termination cap 1 may provide relatively "cool" (or perhaps warm) air for the air wash. This "air wash" air tends to travel though openings 14 in the top or upper side 13 of trim plate 12 which is generally positioned adjacent the exterior surface of the building. In alternate embodiments and alternate shapes of trim plate 12 the combustion air that becomes air wash air may be drawn through trim plate 12 at alternate locations.

Accordingly, this cooler "air wash" air is ejected between (1) the exterior surface of the building and (2) the direct exhaust exiting exhaust body 6 and deflected by deflector 16.

Figure 6:
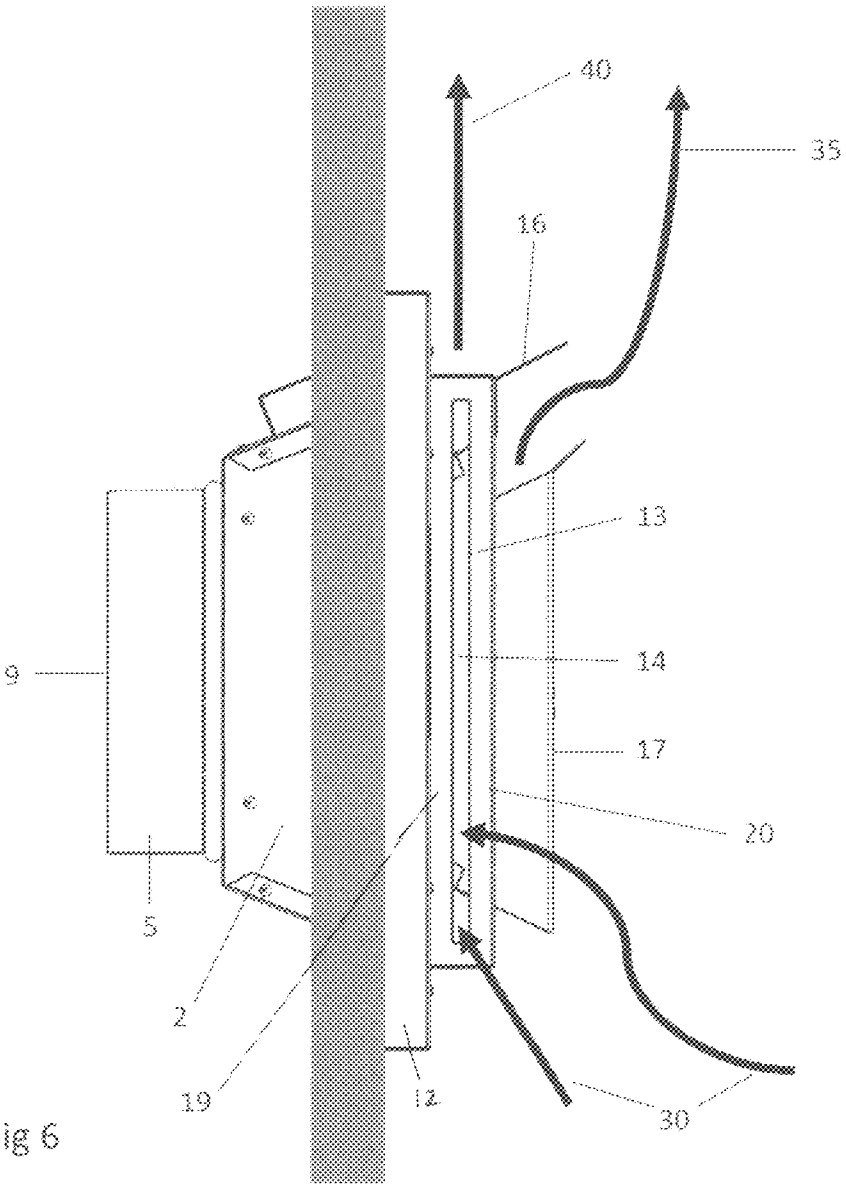
FIG. 6 is a side view of the termination cap of FIG. 1 mounted in the wall of a structure and showing the movement of gases.
Figure 7:
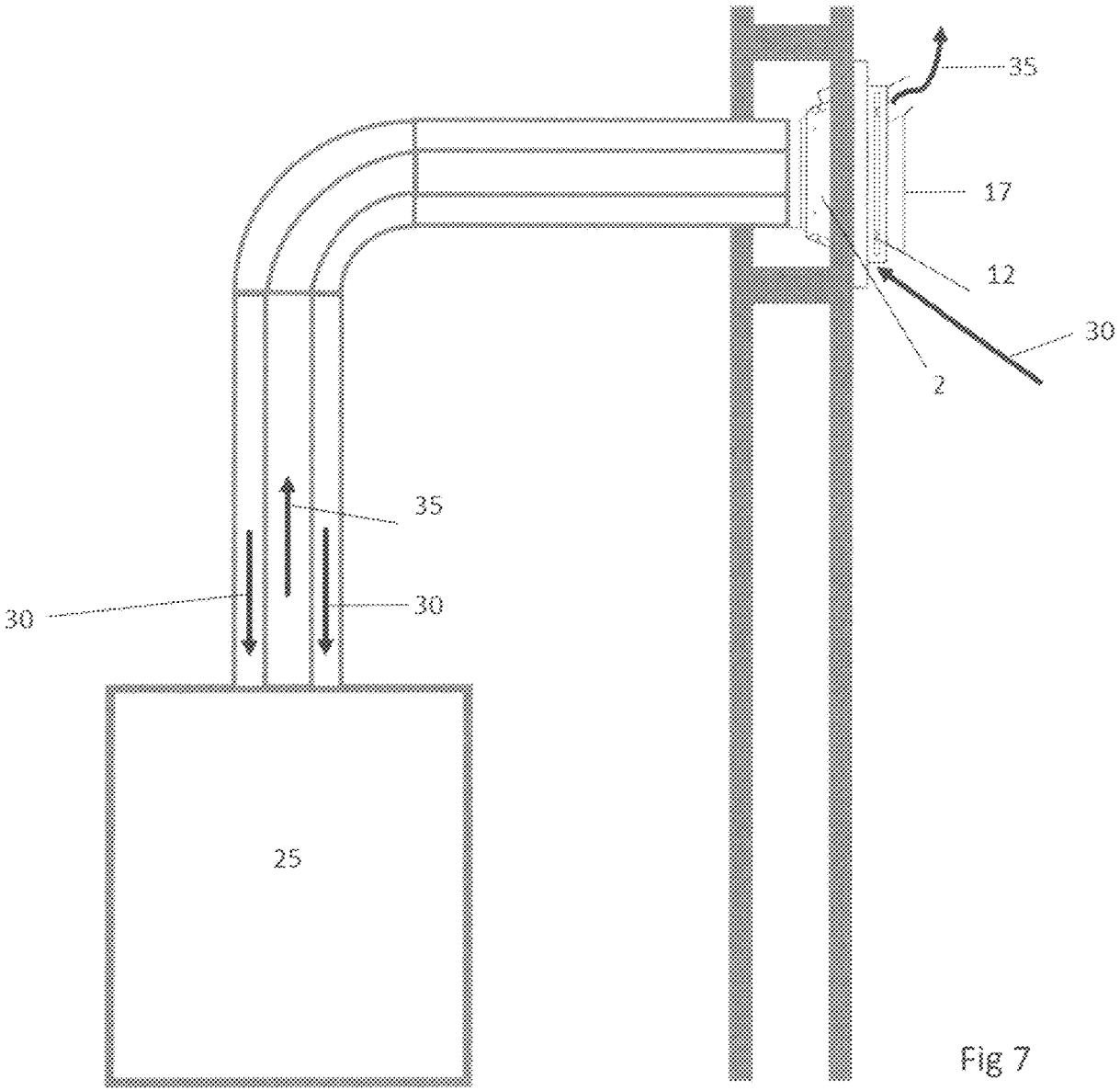
FIG. 7 is a schematic view of a direct vent gas fireplace used in conjunction with a termination cap in accordance with an embodiment of the invention.

As shown in FIG. 6, the air wash helps to "insulate" the surface of the surface or building from the effects of coming into contact with hot exhaust gases that are expelled from the termination cap. It is the necessity to keep hot exhaust gases away from the exterior surface of the building within which the termination cap is mounted that is one of the primary reasons that currently available termination caps are large, bulky structures that extend a significant degree away from a building's surface. In contrast, the structure of the invention described herein allows for a considerably slimmer design while still protecting the surface of the building exterior within which it is mounted from damage due to contact with hot exhaust gases. Further, the nesting effect of the flared housing and the similarly shaped exhaust body helps to permit the mounting of the termination cap largely within a wall structure and not on the exterior wall surface as in the case of existing termination caps.

To assist in the establishment of an air wash along the surface of the building immediately above termination cap 1, the termination cap may include a baffle 11. In one embodiment, baffle 11 is positioned within flared housing 2 and within combustion air passageway 10. Baffle 11 has an enclosed or generally enclosed or solid upper portion 21 and a generally open or perforated lower portion 22 (which may be in the form of a series of holes or openings, a mesh, etc). Lower portion 22 of baffle 11 permits the generally unrestricted flow of combustion or intake air therethrough. The generally enclosed or solid upper portion 21 at least partially restricts or limits the flow of combustion gas through the upper portion of combustion air passageway 10. That limitation or restriction tends to slow the draw of intake or combustion air through the upper portion of trim plate 12, permitting combustion air in the upper portion of the void between sides 13 of trim plate 12 and exhaust baffle 6 to be more significantly heated than if there was no limitation or restriction on flow through combustion air passageway 10. A more significant heating of that air results in a greater volume of air rising and travelling through holes or opening 14 in the top side surface of trim plate 12, thereby enhancing the "air wash" effect.

It is to be understood that what has been described are the preferred embodiments of the invention. The scope of the claims should not be limited by the preferred embodiments set forth above, but should be given the broadest interpretation consistent with the description as a whole.

We claim:

1. A termination cap for a direct vent appliance, the termination cap comprising:

an outer housing having an interior surface, an outer end, and an inner end that is in fluid communication with a combustion air conduit to deliver combustion air to the appliance;

an exhaust body nested within the outer housing and having an exterior surface that is completely encompassed by, and partially offset from, the interior surface of the outer housing thereby forming a combustion air passageway between the exterior surface of the exhaust body and the interior surface of the outer housing, the exhaust body having an inner end in fluid communication with an exhaust conduit from the appliance; and a trim plate having an outer surface that includes an exhaust gas opening therethrough, the outer surface of the trim plate being offset from the outer end of the outer housing by a plurality of sides that include combustion air openings to permit the passage of combustion air into the termination cap, the trim plate positioned exterior to a structure within which the termination cap is located during use, the sides and the outer surface of the trim plate partially defining a void into which combustion air is drawn;

wherein a portion of the combustion air drawn through the combustion air openings and into the void is heated by exhaust gases passing through the termination cap causing a portion of said combustion air to exit through a combustion air opening in an upper one of the sides of the trim plate, heated combustion air exiting through the combustion air opening creating an air wash along a surface of a wall of the structure to help protect the structure from damage from contact with exhaust gases exiting the termination cap.

2. The termination cap as claimed in claim 1 further including a deflector positioned along an outer surface of the trim plate adjacent to a top of the termination cap and adjacent to the exhaust gas opening, the deflector aiding in deflecting exhaust gases expelled through the exhaust gas opening of the trim plate away from the wall of the structure within which the termination cap is mounted.

3. The termination cap as claimed in claim 1 where the outer housing and the exhaust body are nested truncated pyramids dimensioned such that the offset between the interior surface of the outer housing and the exterior surface of the exhaust body is consistent throughout the termination cap.

4. The termination cap as claimed in claim 3 wherein the offset between the interior surface of the outer housing and the exterior surface of the exhaust body provides a cooling effect to the outer housing as combustion air is drawn through the combustion air passageway, permitting the outer housing to be mounted within the wall of the structure without risk of ignition of wall components.

5. The termination cap as claimed in claim 1 including a baffle positioned within the combustion air passageway to restrict the flow of combustion air through an upper portion of the combustion air passageway.

6. The termination cap as claimed in claim 5 wherein the baffle is comprised of an enclosed upper part and a perforated lower part, wherein the lower part permits the flow of combustion gas therethrough whereas the upper part partially restricts the flow of combustion gas therethrough.

7. The termination cap as claimed in claim 1 wherein the combustion air opening in the upper one of the sides of the trim plate is elongate and horizontal, with a longitudinal axis parallel to the wall of the structure.

8. The termination cap as claimed in claim 7 wherein the combustion air opening in the upper one of the sides of the trim plate extends from a first side of the exhaust body to a second side of the exhaust body.

9. A termination cap for a direct vent appliance, the termination cap comprising:

an outer housing having an interior surface, an outer end, and an inner end that is in fluid communication with a combustion air conduit to deliver combustion air to the appliance;

an exhaust body nested within the outer housing and having an exterior surface that is completely encompassed by, and partially offset from, the interior surface of the outer housing thereby forming a combustion air passageway between the exterior surface of the exhaust body and the interior surface of the outer housing, the exhaust body having an inner end in fluid communication with an exhaust conduit from the appliance;

a trim plate having an outer surface that includes an exhaust gas opening therethrough, the outer surface of the trim plate being offset from the outer end of the outer housing by a plurality of sides that include combustion air openings to permit the passage of combustion air into the termination cap, the trim plate positioned exterior to a structure within which the termination cap is located during use, the sides and the outer surface of the trim plate partially defining a void into which combustion air is drawn; and a deflector positioned along an outer surface of the trim plate adjacent to a top of the termination cap and adjacent to the exhaust gas opening, the deflector aiding in deflecting exhaust gases expelled through the exhaust gas opening of the trim plate away from a wall of the structure within which the termination cap is mounted, wherein combustion air drawn through the combustion air openings in the sides of the trim plate and into the void is heated through the passage of exhaust gases through the termination cap causing a portion of said combustion air to exit the void through a combustion air opening in an upper one of the sides of the trim plate, combustion air exiting through the upper one of the sides of the trim plate creating an air wash along a surface of the wall of the structure within which the termination cap is mounted to help protect the surface from damage from contact with exhaust gases exiting the termination cap.

10. The termination cap as claimed in claim 9 including a baffle positioned within the combustion air passageway to restrict the flow of combustion air through an upper portion of the combustion air passageway.

11. The termination cap as claimed in claim 10 wherein the baffle is comprised of an enclosed upper part and a perforated lower part, wherein the lower part permits the flow of combustion gas therethrough whereas the upper part partially restricts the flow of combustion gas therethrough.

12. The termination cap as claimed in claim 9 wherein the combustion air opening in the upper one of the sides of the trim plate is elongate and horizontal, with a longitudinal axis parallel to the wall of the structure.

13. The termination cap as claimed in claim 12 wherein the combustion air opening in the upper one of the sides of the trim plate extends from a first side of the exhaust body to a second side of the exhaust body.

* * * * *